US008967362B2

(12) United States Patent
Ingvarsson et al.

(10) Patent No.: US 8,967,362 B2
(45) Date of Patent: Mar. 3, 2015

(54) APPARATUS, METHOD, SOFTWARE AND GRAPHICAL INTERFACE FOR FLEXIBLE DISPENSING OF COINS IN A COIN HANDLING APPARATUS

(71) Applicant: Scan Coin AB, Malmo (SE)

(72) Inventors: Per-Ola Ingvarsson, Hoor (SE); Nicklas Hallenborg, Eslov (SE)

(73) Assignee: Scan Coin AB, Malmo (SE)

( * ) Notice: Subject to any disclaimer, the term of this patent is extended or adjusted under 35 U.S.C. 154(b) by 0 days.

(21) Appl. No.: 13/934,789

(22) Filed: Jul. 3, 2013

(65) Prior Publication Data

US 2014/0031974 A1 Jan. 30, 2014

Related U.S. Application Data

(60) Provisional application No. 61/675,946, filed on Jul. 26, 2012.

(30) Foreign Application Priority Data

Jul. 24, 2012 (EP) ..... 12177633

(51) Int. Cl.
*G07F 9/00* (2006.01)
*G07F 9/08* (2006.01)
(Continued)

(52) U.S. Cl.
CPC .. *G07D 1/00* (2013.01); *G07D 9/00* (2013.01); *G07D 9/008* (2013.01)
USPC ..... 194/350; 194/215

(58) Field of Classification Search
CPC ..... G07D 1/00; G07D 3/00; G07D 9/008; G07D 2201/00
USPC ..... 194/215, 350, 217; 453/18, 19, 29, 30, 453/58; 700/223, 224, 225, 232, 83, 84; 715/700
See application file for complete search history.

(56) References Cited

U.S. PATENT DOCUMENTS 4,950,203 A 8/1990 Tomaiko
5,297,598 A 3/1994 Rasmussen
(Continued)

FOREIGN PATENT DOCUMENTS

CA 1169734 6/1984 ..... 133/14
GB 14210 6/1911
(Continued)

OTHER PUBLICATIONS

European Search Report Dated Oct. 17, 2012, for Application No. 12177627.2, (6 pages).
(Continued)

*Primary Examiner* — Mark Beauchaine
(74) *Attorney, Agent, or Firm* — Womble Carlyle Sandridge & Rice LLP

(57) ABSTRACT

A coin dispensing apparatus has a cabinet serving as an apparatus housing for the apparatus. The apparatus has a control means for controlling the apparatus. The apparatus further has a module for receiving, optionally validating and optionally sorting coins of different types and at least one dispenser for coins to be dispensed. The apparatus also comprises a filling compartment comprising a plurality of dispense locations. Each dispense location is adapted for receiving a portable coin receptacle for collecting dispensed coins from a specific dispenser. The apparatus is adapted to dispense a specific amount of coins under control of said control means to at least one portable coin receptacle at a specific dispense location in said filling compartment. The control means is adapted to only start the dispense operation at said specific dispense location if a portable coin receptacle is present at the location.

18 Claims, 7 Drawing Sheets

(51) Int. Cl.
*G07D 9/00* (2006.01)
*G07D 1/00* (2006.01)

(56) References Cited

U.S. PATENT DOCUMENTS

| | | | | |
|---|---|---|---|---|
| 6,047,807 | A | 4/2000 | Molbak | |
| 6,719,121 | B2 * | 4/2004 | Alexander et al. | 194/350 |
| 7,018,285 | B2 | 3/2006 | Enomoto | |
| 7,625,272 | B1 * | 12/2009 | Moreland et al. | 453/3 |
| 2003/0032388 | A1 | 2/2003 | Rasmussen et al. | |
| 2004/0231955 | A1 | 11/2004 | Carter | |
| 2004/0231956 | A1 * | 11/2004 | Adams et al. | 194/217 |
| 2006/0019591 | A1 | 1/2006 | Abe et al. | |
| 2007/0108267 | A1 | 5/2007 | Jonsson et al. | |

FOREIGN PATENT DOCUMENTS

| | | | | |
|---|---|---|---|---|
| GB | 102491 | | 7/1917 | |
| JP | 2004-326418 | | 11/2004 | G07D 1/00 |
| JP | 2007-280010 | | 10/2007 | G07D 9/00 |
| WO | WO 2005/014046 | A1 | 11/2005 | G07D 9/00 |
| WO | WO 2007/035420 | A2 | 3/2007 | G06F 7/00 |
| WO | WO 2008/024043 | A1 | 2/2008 | G07F 9/06 |

OTHER PUBLICATIONS

European Search Report Dated Oct. 17, 2012, for Application No. 12177631.4, (5 pages).

European Search Report Dated Oct. 17, 2012, for Application No. 12177633.0, (5 pages).

* cited by examiner

APPARATUS, METHOD, SOFTWARE AND GRAPHICAL INTERFACE FOR FLEXIBLE DISPENSING OF COINS IN A COIN HANDLING APPARATUS

CROSS-REFERENCE TO RELATED APPLICATIONS

This application claims the benefit of European patent application Ser. No. 12177633.0, filed on Jul. 24, 2012; and claims the benefit of U.S. Provisional Patent Application No. 61/675,946, filed Jul. 26, 2012.

INCORPORATION BY REFERENCE

The entire disclosures of European patent application No. 12177633.0, filed on Jul. 24, 2012; and U.S. Provisional Patent Application No. 61/675,946, filed Jul. 26, 2012, are incorporated herein by reference as if set forth in their entireties.

TECHNICAL FIELD

The present invention generally relates to cash handling, and more specifically to coin deposit equipment and coin dispensing equipment.

BACKGROUND ART

Retail cash systems (RCS) are used for handling of cash, such as notes (bills), cheques or coupons in a retail establishment. The systems generally comprise a coin deposit apparatus and a coin dispensing apparatus.

The coin deposit apparatus has to discriminate between different types of acceptable coins, such as valid coins in a plurality of denominations in one or more specific currencies. Preferably, it should also be capable of detecting unacceptable cash, such as fake (counterfeit) coins or coins of a foreign currency. In the coin deposit apparatus a coin acceptance module (CAM) handles the discrimination of coins and is also adapted to count the coins to register the deposited amount. One typical user is a cashier emptying a till after a work shift.

The coin dispensing apparatus contains coins of various denominations. It generally dispenses a specified composition or amount of coins based on the input of a user. It also registers the amount of coins dispensed. The coin dispensing apparatus contains several storage receptacles, typically one for each type of denomination to be dispensed, from which coins are dispensed. One typical use case in this context is a cashier filling a till at the beginning of a work shift.

The coin deposit apparatus and the coin dispensing apparatus can be combined into what is called a coin (or cash) recycling system. In order for such a system to work properly the coin acceptance module of the system also includes sorting capabilities, so that different denominations are discriminated and stored separately from each other, while waiting to be dispensed.

The coin recycling system also has a controller keeping track of all transactions occurring in the system. The system can therefore be utilized as the heart of a settlement system for a retail establishment.

WO-05/104046 discloses a cash recycling machine for a retail establishment in accordance with what has been described above. WO-05/104046 describes how a till is placed with its front end supported on a ledge in order to receive multiple denominations in a sorted condition simultaneously. The described system also provides for bagging operations.

WO-2008/024043 relates to a coin deposit and dispensing apparatus having a cabinet serving as an apparatus housing for the apparatus. The apparatus further has a controller and several dispensers for coins to be dispensed. The apparatus is adapted for dispensing a specific composition of coins under control of the controller from the dispensers to a portable coin receptacle. A closable dispense space is arranged within the cabinet, and the closable dispense space has an open state which permits reception of the portable coin receptacle to be filled, and a closed state which permits dispensing of the specific composition of coins from the dispensers into the portable coin receptacle while shielding the closable dispense space from external access during the dispensing.

The apparatus of WO-2008/024043 is large, complex, and advanced being capable of handling large volumes of coins, which renders it suitable for large retail establishments. There is, however, also a need for coin deposit and dispensing apparatus in smaller retail establishments. The demands on such an apparatus are different in such smaller establishments. A small size and a lower price are important. There is therefore a need for a more compact but still efficient coin deposit and dispensing apparatus. There is also a need for such a coin deposit and dispensing apparatus to be simple and time efficient to use.

SUMMARY

The present invention generally aims at eliminating or at least reducing the problems discussed above as well as other problems. This is accomplished with an apparatus, a method, software and a graphical interface in accordance with the appended independent claims.

To better address one or more of these and other concerns, in a first aspect of the invention a coin deposit and dispensing apparatus is provided having a cabinet serving as an apparatus housing for the apparatus;

a control means for controlling the apparatus;

a cash processing module adapted to receive a deposited mass of coins, said module optionally including a coin acceptance module for processing said deposited mass of coins;

a plurality of dispensers for coins to be dispensed, the dispensers each having a hopper mounted on an ejector/counter, the each of the hoppers having an upper part receiving pre-sorted coins or coins from the coin acceptance module and a lower part connected the ejector/counter; and a filling compartment comprising a plurality of dispense locations, each dispense location being adapted for receiving a portable coin receptacle for collecting dispensed coins from a specific dispenser;

wherein, in a deposit operation, the coin deposit and dispensing apparatus is adapted for distributing specific coins to specific dispensers, and each dispenser is adapted to receive a specific type of deposited and processed coins for buffering therein; and wherein, in a dispensing operation, each dispenser is adapted to dispense a specific amount of coins, under control of the control means, to a portable coin receptacle at a specific dispense location in said filling compartment, wherein the control means is adapted to only start the dispense operation at said specific dispense location if a portable coin receptacle is present at the location.

By only starting the dispense operation as described above, a more flexible and time efficient way of dispensing coins from a coin dispensing apparatus may be achieved. The dispense operation will not start unless the coin receptacles needed are present. Consequently, the risk of dispensing coins into the interior of the apparatus may be reduced. A further effect of the present invention is that only the dispense location of each coin type that is to be dispensed needs to have a portable coin receptacle present in order to start the dispense operation. If, for example, only one coin type is to be dispensed, there is only need for a coin receptacle at the dispense location of that coin type. This may lead to a more time efficient handling of the dispensing of coins.

The filling compartment may further comprise guiding structures for guiding a portable coin receptacle to its correct position in the filling compartment. An advantage of this may be that the chance of placing the portable coin receptacles correctly is increased. As an alternative, the guiding structure may be replaced by marks or lines in the filling compartment.

By the term "coin type" should, in the context of the present application, be understood coins having at least one common feature. Typically, a coin type may be comprised of coins of a certain currency having a specific value. Regarding the euro currency, there are eight different coin types (1 cent, 2 cent, 5 cent, 10 cent, 20 cent, 50 cent, 1 euro, and 2 euro). However, in some circumstances it could be desirable to classify different kinds of coins into a single coin type.

By the term "portable coin receptacle" should, in the context of the present application be understood a container adapted for being received at a dispense location in the filling compartment of the coin deposit and dispensing apparatus. Typically, a portable coin receptacle in accordance with the present invention has a single compartment for storing a single coin type.

By the term "dispense location" should, in the context of the present application be understood a specific part of the filling compartment of the coin deposit and dispensing apparatus, which part is adapted for receiving a portable coin receptacle and for dispensing a particular coin type in a portable coin receptacle.

By the term "control means" should, in the context of present specification, be understood means for connecting the apparatus to an external control unit, such as a personal computer. The control means could, for example, be a set of cable connections or means for enabling wireless connection such as Ethernet or Bluetooth.

According to an embodiment of the present invention, the coin deposit and dispensing apparatus further having at least one sensor arranged to detect presence of a portable coin receptacle at a dispense location and wherein the at least one sensor is coupled to the control means. The sensor could be of any suitable type such as a sensor detecting pressure, an optical sensor or a proximity sensor.

An effect of this embodiment may be that the sensor automatically will detect if a portable coin receptacle is present at the dispense location for a specific coin type to be dispensed. An advantage of this may be that the risk of dispensing coins into the interior of the apparatus is reduced. A further advantage may be that the dispense operation may be started as soon as the last needed coin receptacle is inserted at an appropriate dispense location in the filling compartment of the coin deposit and dispensing apparatus and thus time may be saved.

According to a further embodiment of the present invention, the apparatus is adapted for receiving information about a maximum amount of coins that can be successively dispensed to a portable coin receptacle in dispensing operation, and to forward this information to the control means, and wherein the control means is adapted to, in a dispense operation, only allowing the apparatus to successively dispense the number of a specific coin or coins up to the upper limit. An advantage of the present embodiment may be that the risk of dispensing coins into the interior of the apparatus is reduced.

In one embodiment, the apparatus is adapted for receiving information about the maximum amount of a specific coin type that can be successively dispensed to a portable coin receptacle. In this embodiment, the apparatus is also adapted for restricting the amount of coins that can be successively dispensed at the dispense location where coins of said coin type are dispensed.

In another alternative embodiment, said sensor is capable of identifying a specific identification means on a portable coin receptacle present at said dispense location. The identification means is associated with a maximum amount of coins to be successively dispensed. In response to the detection of such an identification means, the apparatus is adapted for restricting the amount of coins that can be successively dispensed at the dispense location where the identification means has been identified.

As disclosed herein, the term "identification means" relates to anything that could be detected by a sensor and associated with a certain value. Examples of suitable identification means could be an RFID tag present on the portable coin receptacle. Alternatively, another identification means could be some specific features on the receptacle, such as cavities or protrusions, that could be detected by the sensor.

In a preferred embodiment of the present invention, the control means is adapted to start subsequent dispense operations at a certain dispense location if a requested amount of coins exceeds the maximum amount for that dispense location. An advantage of this may be that the user can disregard any upper limit of how many coins that may fit into a coin receptacle when specifying the specific amount of coins of a coin type to be dispensed. The correct amount may be dispensed, although in several separate dispensing operations, without any risk of dispensing coins into the interior of the apparatus, even though it may require that some of the coin receptacles must be emptied and inserted into the coin deposit and dispensing apparatus at least once before the entire specific composition of coins to be dispensed is fully dispensed.

In a second aspect, the present invention provides a method for dispensing coins from a coin deposit and dispensing apparatus, the method comprising the steps of a) providing a coin deposit and dispensing apparatus according to the first aspect of the present invention;

b) providing at least one portable coin receptacle;

c) initiating, by a control means, a dispense operation;

d) specifying the specific amount of coins of each coin type available in the apparatus to be dispensed, each coin type having a determined dispense location; and e) for each dispense location i) controlling, by a sensor and the control means, if there is a portable coin receptacle present at the specific dispense location of that coin type; and ii) starting, by the control means, the dispense operation only if there is a portable coin receptacle present at the specific dispense location and only if an amount of coins of a coin type dispensed at the dispense location has been specified in step d).

The dispense operation may be initiated by a physical person or it may be an automatically started operation. The specific amounts of coins of each coin type available in the apparatus that are to be dispensed may consist of one or more different denominations of the same currency or it may consist of several different currencies. The determined dispense location for a coin may thus depend on for example the denomination or the currency. Several denominations may share the same dispense location but typically each denomination has its own dispense location.

According to a further embodiment of the present invention, the control means may indicate any specific dispense location of a specific coin type where no portable coin receptacle is present. The indication may, for example, be a visual indication or an audio indication. The indication may also be negative, that is that dispense locations where a portable coin receptacle is present are highlighted. The indication may be shown or played on an external control unit connected to the coin deposit and dispensing apparatus via the connection means or it may be shown or played on the apparatus itself. An advantage of having such an indication may be that it is clearly presented on what dispense location in the apparatus a portable coin receptacle needs to be inserted in order to actuate the dispense operation.

According to a preferred embodiment of the second aspect of the present invention, the portable coin receptacle of step b) comprises an identification means, said identification means being associated with a maximum amount of coins to be successively dispensed at the dispense location where the portable coin receptacle is entered; and step e), substep i) also comprises detecting presence of an identification means on any portable coin receptacle present at said dispense location, said identification means being associated with a maximum amount of coins that can be successively dispensed into the portable coin receptacle at the dispense location. The method further comprises the steps of:

for each dispense location iii) interrupting, by said control means, said dispense operation when an amount corresponding to the maximum amount of coins has been dispensed;

iv) detecting, by said control means, that a portable coin receptacle has been removed from the specific dispense location followed by detection that a portable coin receptacle has been entered at the specific dispense location; and v) for the remaining amount of coins, repeating step e), substeps ii), iii) and iv) until the whole amount of the coin type that was specified in step d) has been dispensed.

According to an alternative embodiment of the method, step d) further comprises that a maximum amount of coins of a certain coin type that successively can be dispensed is specified. The coins of the coin type are dispensed at a specific dispense location. The method further comprises the steps of:

for each dispense location iii) checking the maximum amount of coins that can successively dispensed at the dispense location and interrupting, by said control means, said dispense operation when an amount corresponding to the maximum amount of coins has been dispensed;

iv) detecting, by said control means, that a portable coin receptacle has been removed from the specific dispense location followed by detection that a portable coin receptacle has been entered at the specific dispense location; and v) for the remaining amount of coins, repeating step e), substeps ii), iii) and iv) until the whole amount of the coin type that was specified in step d) has been dispensed. According to a preferred embodiment of the second aspect of the present invention, a portable coin receptacle is presumed empty when inserted at a dispense location. An effect of this may be that no sensor is required for keeping track of whether a coin receptacle is empty or not. This may lead to a lower manufacturing cost.

According to yet another preferred embodiment of the second aspect of the present invention, step e), substep i) is carried out in such a way that the control means initially checks if a portable coin receptacle has been removed from the specific dispense location since the latest dispense operation was carried out, and If no portable coin receptacle has been removed, the method is interrupted until the portable coin receptacle has been removed; and If a portable coin receptacle has been removed, the method proceeds at step e), substep i).

An advantage of having such an indication may be that it is clearly presented what portable coin receptacle that needs to emptied in order to actuate the dispense operation. The indication may be a visual indication or an audio indication. The indication may be shown or played on an external control unit connected to the coin deposit and dispensing apparatus via the connection means or it may be shown or played on the apparatus itself. A further advantage of the present embodiment may be that the risk of overflowing a coin receptacle when actuating a dispense operation is reduced. A further advantage may be that coin receptacles present at a dispense location not affected by a dispense operation do not need to be emptied in order to actuate the dispense operation. An effect of the present embodiment may be that the algorithm for handling the number of a specific coin or coins that can be dispensed into a certain coin receptacle is simplified due to the fact that a coin receptacle is presumed empty when inserted in the apparatus.

In a third aspect, the present invention provides a computer program product comprising computer program code portions adapted to perform the method according the second aspect of the present invention when loaded and executed on a computer connected to an apparatus according to the first aspect of the present invention via a connection means.

The third aspect may generally have the same features and advantages as the first and second aspect.

In a forth aspect, the present invention provides a graphical user interface for communication between a user and a computer set up to run a computer program product according to the third aspect, the graphical user interface having:

a section for specifying the specific amount of each coin type that is to be dispensed, each such coin type having a determined dispense location;

a section for indicating if a portable coin receptacle is present or not in the determined dispense location of each coin type.

By the term "section" should, in the context of present specification, be understood a graphical part of the user interface.

In yet another embodiment of the present invention, the graphical user interface may further have:

a section for indicating whether any portable coin receptacle present at a dispense location has not been emptied since a previous dispense operation;

The forth aspect may generally have the same features and advantages as the first, second and third aspect.

Other objectives, features and advantages of the present invention will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

Moreover, the term "coins" is to be interpreted as encompassing monetary coins but also similar value-representing objects such as markers or tokens.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, where the same reference numerals will be used for similar elements, wherein.

DETAILED DESCRIPTION OF EMBODIMENTS OF THE INVENTION

Figure 1:
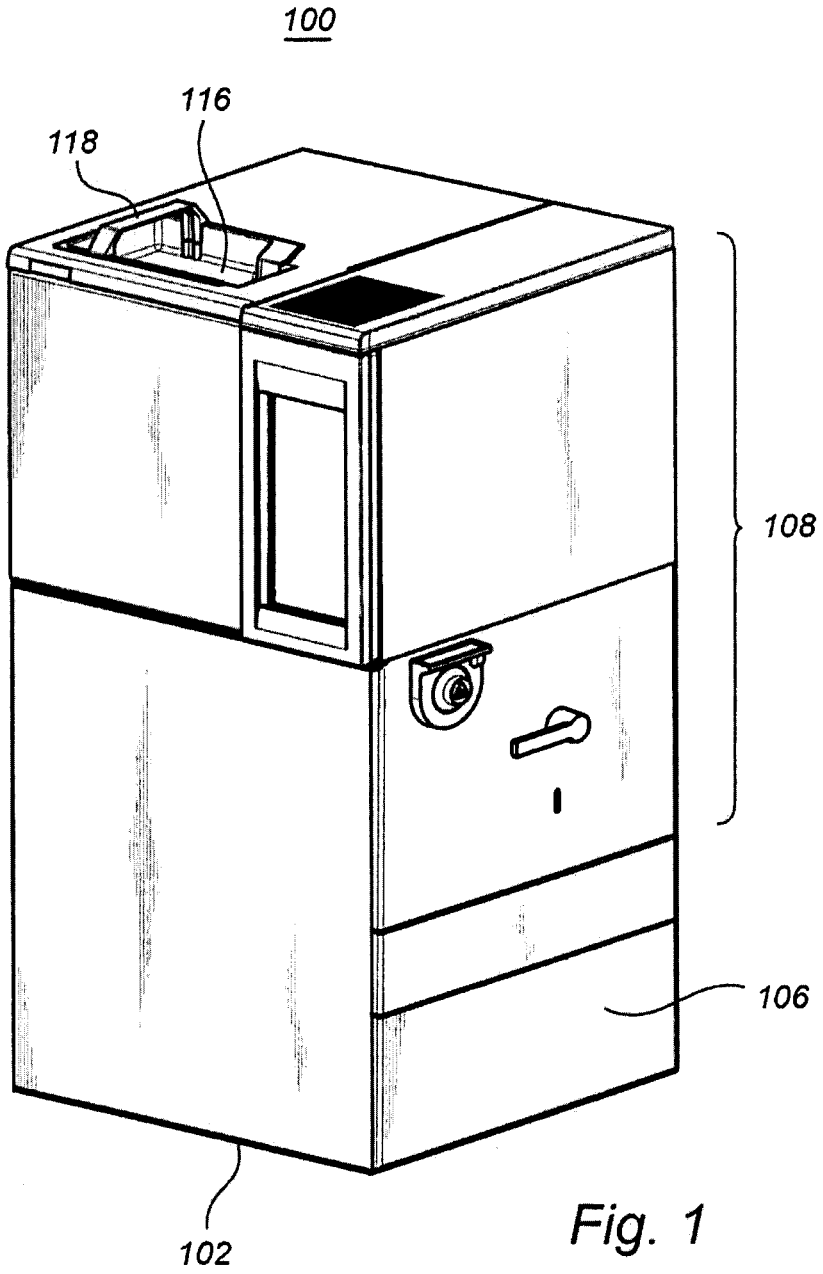
FIGS. 1-5 are perspective front views of a coin deposit and dispensing apparatus according to an embodiment of the present invention.

FIG. 1 illustrates a coin deposit and dispensing apparatus 100 in accordance with a first embodiment of the invention. The apparatus is comprised in a single cabinet 102 and includes several combined modules, each filling one or more specific functions. It is emphasized that the combination of modules, as well as functions within an individual module, described in the following in some detail with reference to the drawings is not the only possible alternative. Modules and functions within individual modules can be added, altered, and excluded without leaving the inventive concept as defined by the appended claims.

The apparatus 100 generally consists of two main modules: a cash storage module 106 at the bottom of the apparatus, and a cash processing module 108 above the cash storage module. These modules 106, 108 are divided into sub modules and will be described in the following.

The purpose of the apparatus 100 is to simplify and render more effective the handling of cash in general and coins in particular. Instead of sending all incoming coins from customers to a remote bank or CIT company and thereafter receiving coins for daily operation from the same bank, etc., the apparatus 100 renders it possible to recirculate coins from customers to the highest possible extent. This reduces costs related to CIT operations and work related to handling and maintenance. Further, the apparatus 100 simplifies the daily handling of coins. The apparatus 100 according to an embodiment of the invention has two main operations: coin deposit (where coins are input by a user and then optionally counted, optionally sorted and buffered) and coin dispensing (where coins buffered in the apparatus are dispensed to a user).

The apparatus 100 has control means (not shown) for controlling the apparatus. Typically means for connecting the apparatus to an external control unit is a set of cable connections or a means for enabling wireless connection. The machine may also be controlled by an internal control unit that optionally is connected to an external network or an external computer. In order to minimize size of the coin deposit and dispensing apparatus, it is preferred that the machine only contains means for connecting it to an external control unit. It is easy for the skilled person to select suitable wireless or cable-based connection solutions.

Other embodiments may however use one or more local control units in some or all of the modules of the apparatus, such local control units being configured to cooperate as required.

In some embodiments, the control units may serves as a central controller unit for the entire apparatus 100, including the coin processing module 108.

In one embodiment, the user deposits coins into the apparatus by simply fill pre-sorted coins directly into one or more individual coin dispensers 142. This embodiment is not shown in the enclosed figures. Here, the function of the cash processing module 108 is simply to allow the user to deposit the coins directly into the apparatus 100.

When depositing coins in another embodiment, the user empties, for example, a till into a coin input tray 116. The contents of such a till can be a mixed mass of coins, valid as well as invalid, as well as other foreign material such as paper clips, dust etc. Note that valid coins could include more than one currency (including tokens, jubilee coins, gift coins and such). The end-user may then tilt the tray 116 by lifting it by the handle 118, thereby causing the contents to slide down the bottom surface of the tray 116 and into the interior of the cash processing module 108.

Figure 2:
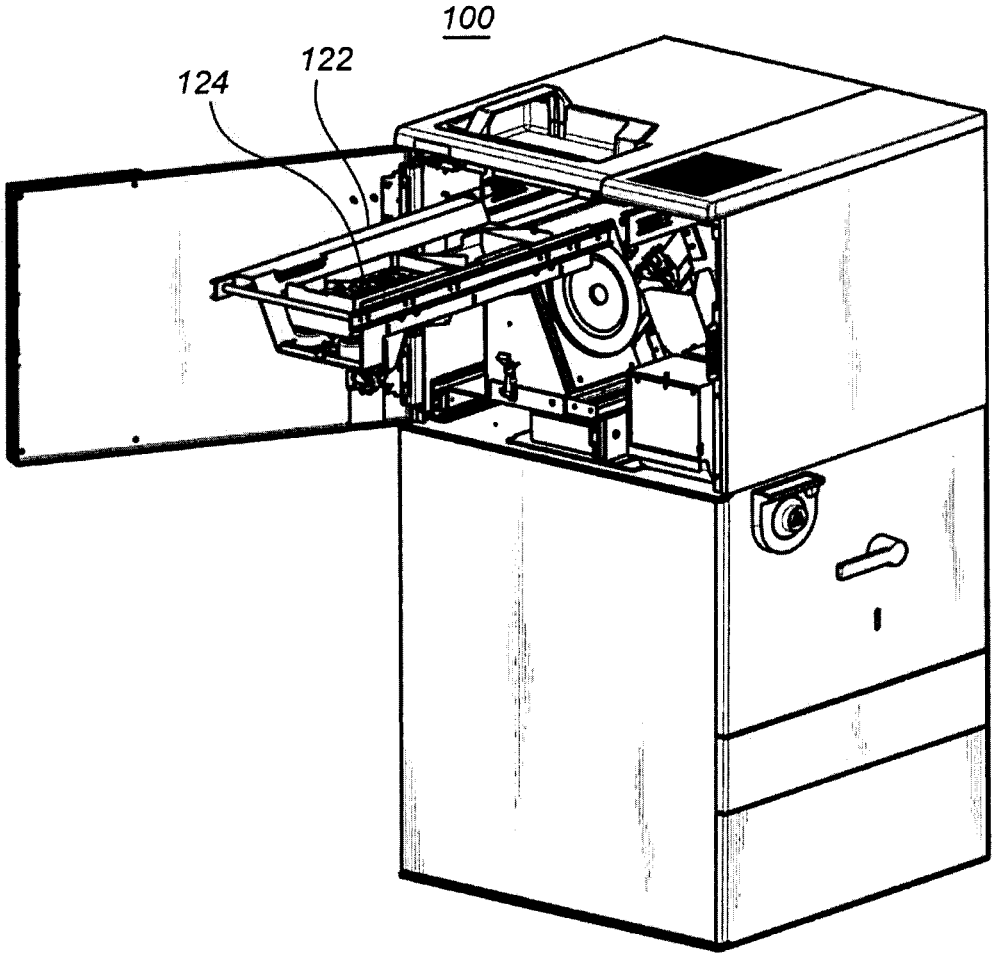

In the cash processing module 108 the contents may first pass an automatic coin conditioning (ACC) unit 122. This unit is shown in greater detail in FIG. 2. Like most of the other sub modules the ACC-unit 122, if present, is slidably arranged on a pair of rails so that it can be retractably pulled out from the interior of the cabinet. In FIG. 2 the ACC-unit 122 is shown in the pulled-out state. The ACC-unit involves a vibratory arrangement of perforated plates 124. This arrangement will separate foreign matter from the mass of coins. When the cash has been conditioned in the ACC it is forwarded to a coin acceptance module (CAM) 126.

Figure 3:
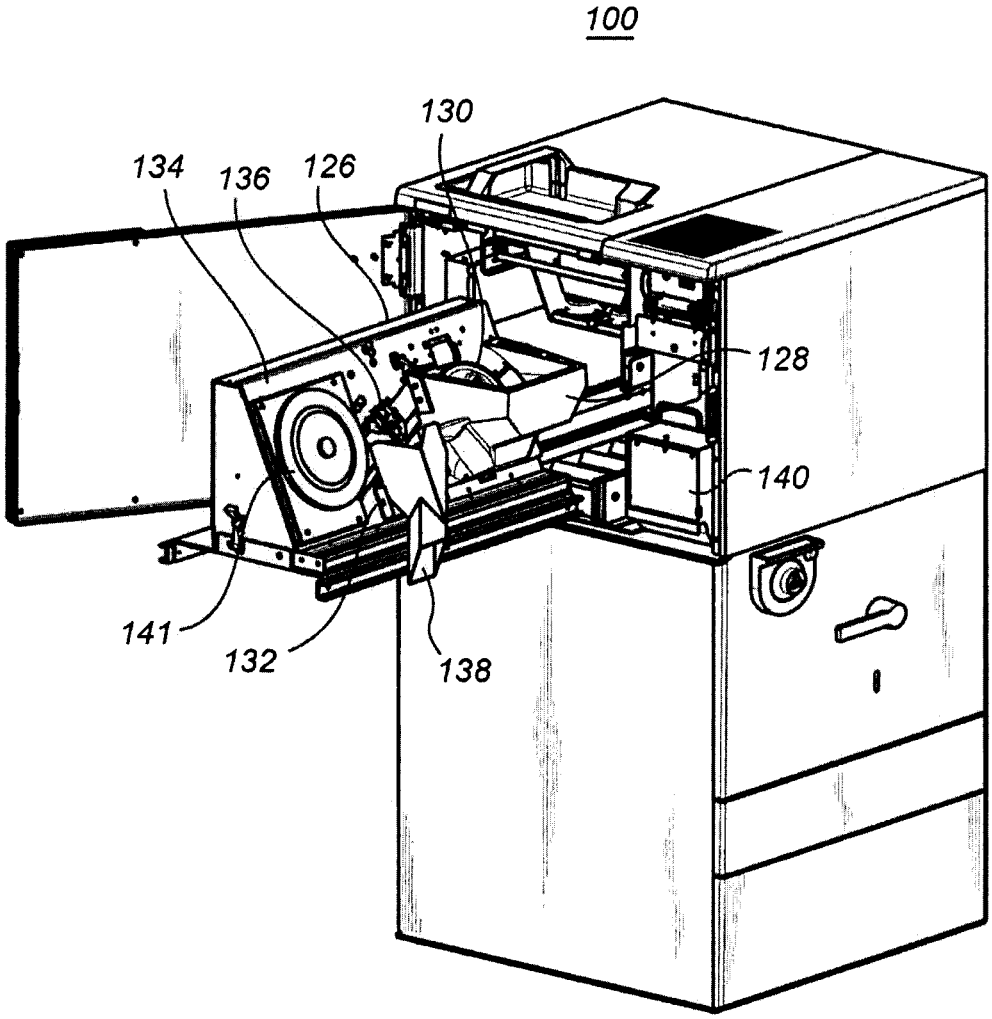

The optional coin acceptance module 126 is shown in greater detail in FIG. 3, in a pulled-out state, similar to the ACC-unit of FIG. 2. One purpose of the CAM 126 is to separate valid coins from invalid ones. The CAM 126 also serves the purpose of determining the type (e.g. denomination) of the valid coins, to count the number of valid coins of each type (denomination), and to sort them, thus enabling full control of transactions occurring thus far in the apparatus 100. The ACC 122 forwards the conditioned coins to a hopper bowl 128 via a receiving tray (not shown). A rotary flexible disc 130 is provided in the hopper bowl 128 and acts to pick up individual coins and bring them to the beginning of a downwardly sloping coin rail 132, mounted to a backwardly inclined front plate 134 of the CAM 126. Each coin will roll, by gravity, down the coin rail 132 and past a coin sensor unit 136.

The coin sensor unit 136, when present, will detect certain physical properties of the passing coin, such as conductivity, permeability, diameter and thickness, and compare these to pre-stored coin reference data in a memory by way of a processor in or coupled to the CAM 126. If the comparison fails to identify the coin as a coin of a valid denomination, it will be regarded as invalid and be deflected through a reject channel 138 to a cash reject area 140.

If on the other hand a valid denomination has been established for the coin, its denomination or associated value will be recorded for later use when calculating a total value for all valid coins processed during the coin deposit transaction upon its completion.

Valid coins roll down the rail 132 and are transported by a rotary carrier disc 141 along a circular sorting path across a series of openings in the front plate 134. The openings are of increasing size, such that coins of the smallest diameter will fall down through the first opening in the transport direction, whereas coins of the second smallest diameter are separated through the next opening, etc. After passing through one of these openings, the coin is guided into a dispenser 142 of a dispenser unit 144 by one of a plurality of channels (not shown). The lower ends of all these channels are arranged on a straight line at regular intervals.

As disclosed herein, the term "coin acceptance module" typically relates to a module for receiving, validating and sorting coins of different types. An example of a suitable such coin acceptance module can be found in the above mentioned WO-2008/024043. However, any such coin acceptance module of reasonable size where the coins are dispensed along a straight line could be used in accordance with the present invention.

Figure 4:
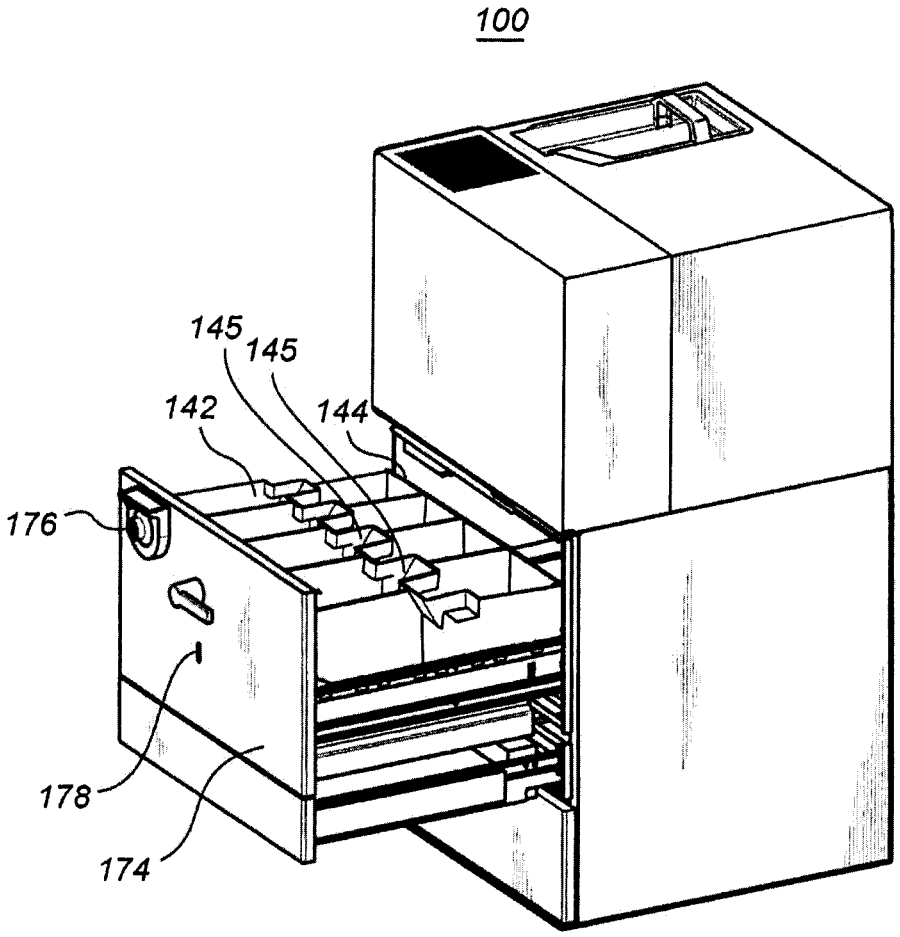

The thus sorted coins will be dispensed along a straight line directly into correct dispensers 142 of a dispenser unit 144, best seen in its pulled-out state in FIG. 4. Each dispenser 142 comprises a spout 145 adapted to guide a coin dispensed from above the spout into the dispenser. By arranging the dispenser in such a way as shown in FIG. 4, the spouts are placed in a row, thereby removing the need of having a complex channel system for guiding the sorted coins into correct dispensers.

In one embodiment, the coin dispenser drawer 174 is opened with a security lock 176 code and a key inserted in a key hole 178. In other embodiments, the locking mechanism is removed. In a further embodiment, the drawer is replaced by a hatch.

Note that valid coins could include more than one currency, e.g. a retail establishment could accept more than one currency (including tokens, jubilee coins, gift coins and such) as payment from its customer. The change given back to a customer, however, usually includes a single currency. This means that the CAM accepts coins that are not to be dispensed at a later stage. These latter coins can be stored in separate dispensers 142 (by denomination/type) or by a single dispenser 142.

Figure 5:
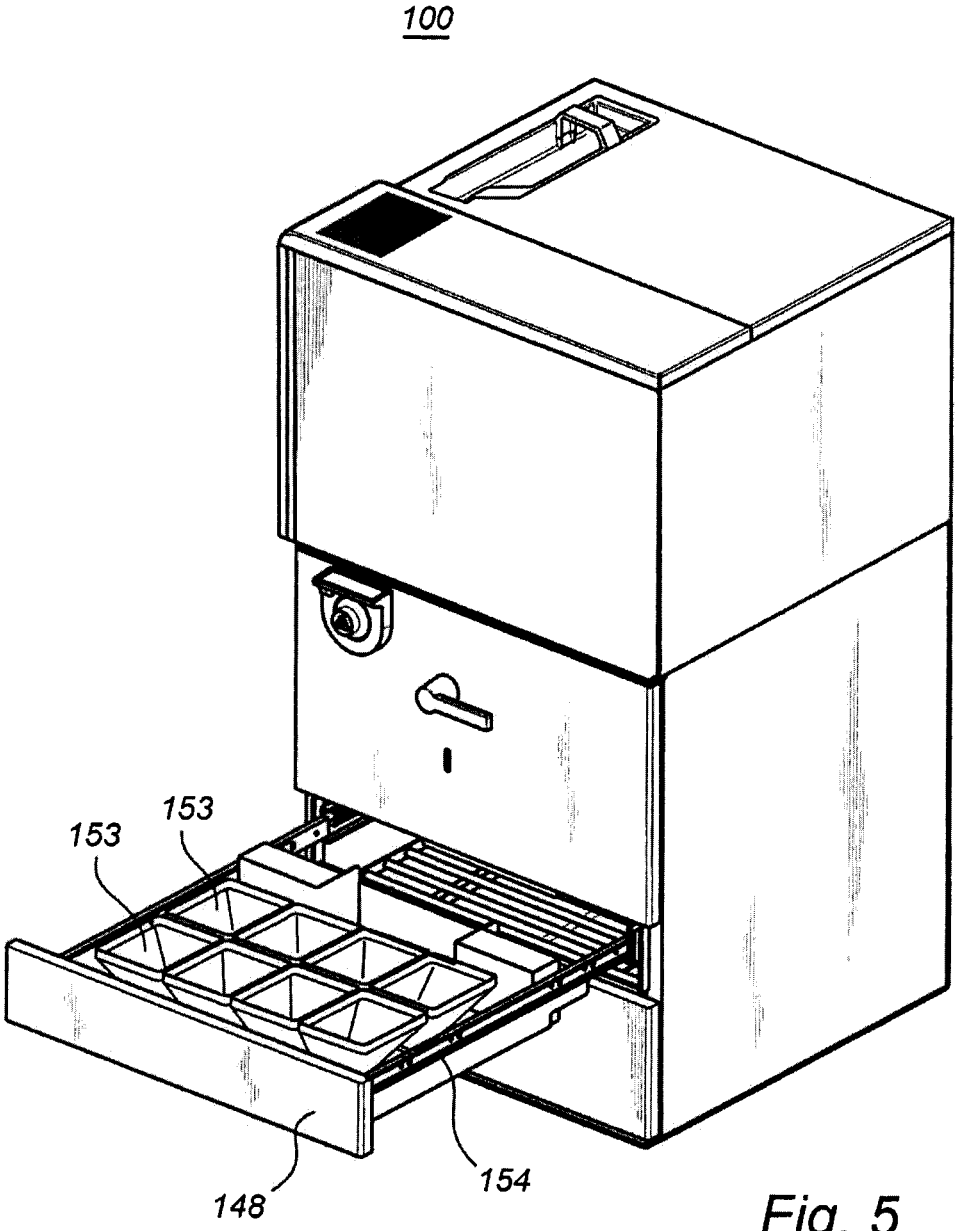
Figure 6:
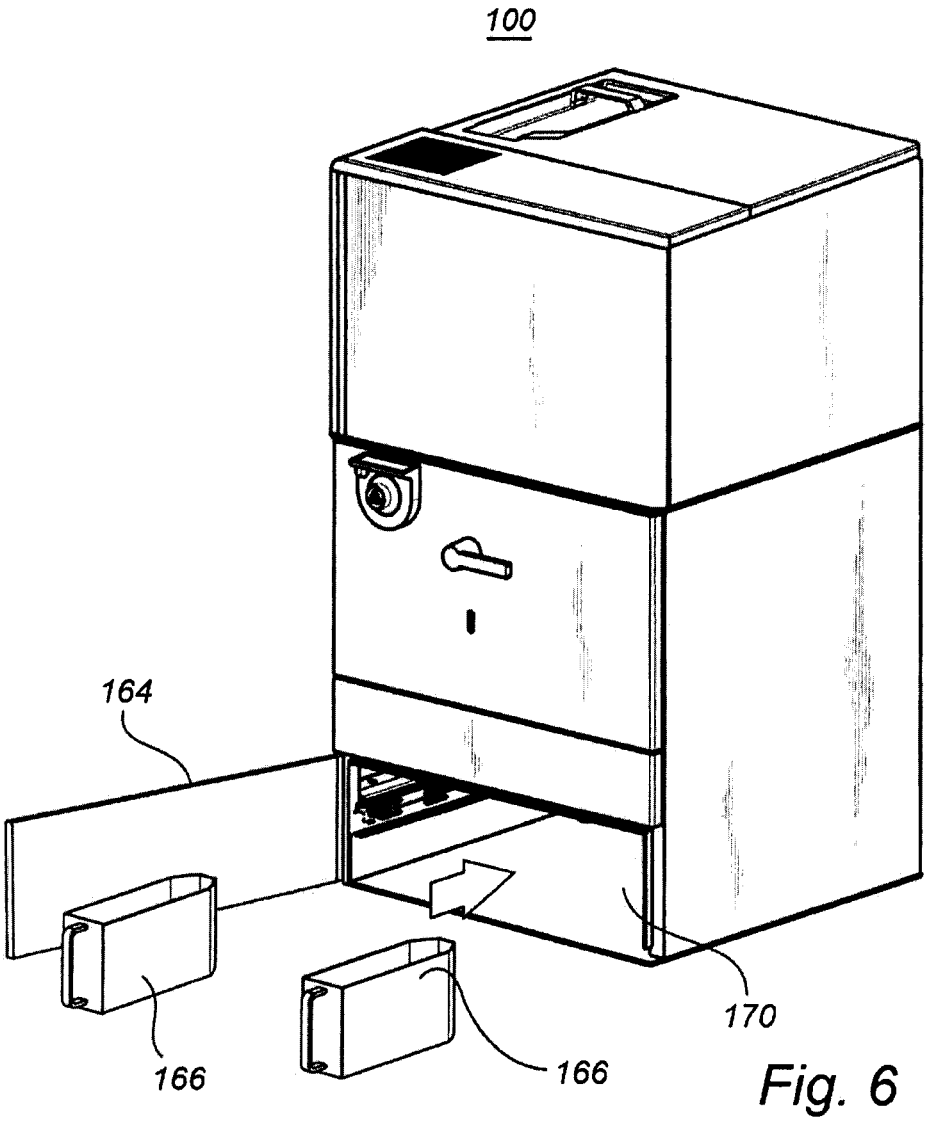
FIG. 6 is a perspective front view of a coin deposit and dispensing apparatus illustrating an alternative of collecting dispensed coins according to an embodiment of the present invention

The filling distributors 153, best seen in its pulled-out state in FIG. 5, will guide the coins to the ejector/counter 147 and further down to a storage means. In another embodiment the filling distributors 153 are mounted in a frame means directly beneath the dispensers 142 as seen in FIG. 4. The apparatus 100 is generally customized for a set of portable coin receptacles or coin cups 166, as seen in FIG. 6. According to an embodiment of the present invention it is only needed to insert the coin cups 166 corresponding to the dispenser 142 wherein the coins to be dispensed are buffered at the moment for actuating or starting the dispense operation. In the illustrative example of FIG. 6, only two denominations of coins are being dispensed, thus only the corresponding two coin cups 166 needs to be inserted for the dispensing operation to start. As an alternative, only the first denomination may be dispensed in a first dispense operation and the second denomination in a subsequent dispense operation, resulting in that only one coin cup is needed. In the latter case, it is important to keep track so the second dispensing operation does not lead to the coin cup being overflowing.

An exemplary dispense operation will now be described.

When the user wishes to fill a portable coin receptacle, such as a coin cup 166 (see FIG. 6), the user instructs the apparatus to dispense coins by entering a command on the personal computer or similar external control means. The user opens door 164 and enters the number of coin cups 166 needed into the filling compartment 170 of the apparatus. When the portable coin receptacle(s) are in a filling position, one or more sensors (not shown) send indication to the external control means and the dispensing operation could be started. An alternative to the one or more sensors may be one or more mechanical switches. A further alternative may be that the user enters a verification command to the external control means.

Figure 7:
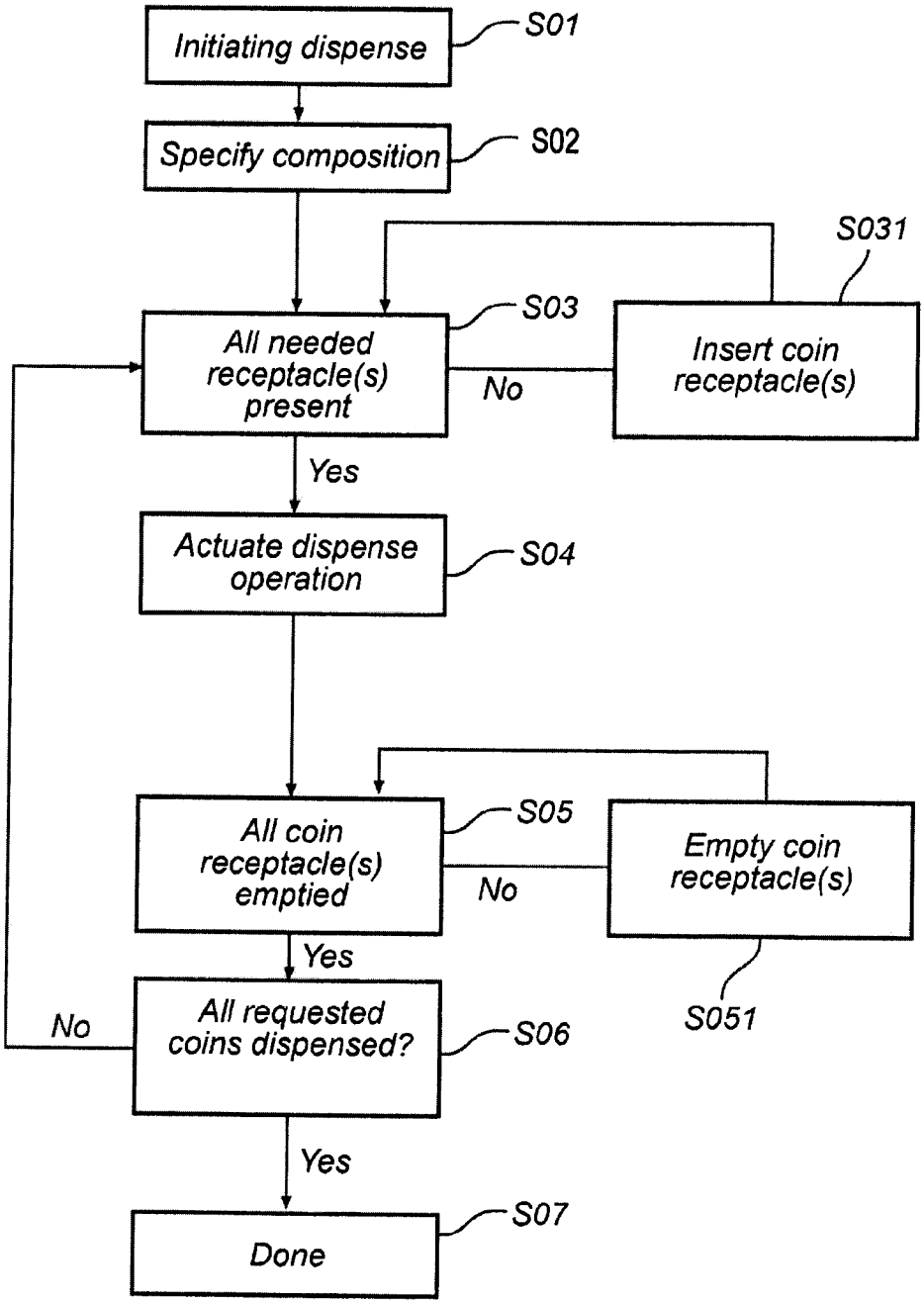
FIG. 7 is a flowchart of a method according to an embodiment of the present invention.

FIG. 7 is a flow chart of a method according to an embodiment of the present invention. The user starts by initiating the dispense operation SOI and then specifies the composition of coins S02 to be dispensed. After specifying the composition of coins S02, the presence of the needed coin cups 166 is checked S03. If not all of the coin receptacles 166 is present at the determined dispense locations (in the filling compartment 170), the user is instructed to insert the missing coin receptacles S031. In one embodiment of the present invention, an inserted coin receptacle is considered empty. In this embodiment no extra sensor for checking if a receptacle is empty or not is needed. In an alternative embodiment, a sensor may send indication to the external control means considering the fill status of the coin receptacles. When the presence of the needed coin receptacles is verified, the external control means will actuate the dispense operation S04 and dispense all the coins in the entire specified composition of coins into their respective the coin receptacle, in the case they all fit into their respective coin receptacle. In the other case, only the amount of coins that will fit into their respective coin receptacle will be dispensed. When the dispense operation is completed, the next step is to check so all coin receptacles have been emptied S05 since the dispense operation. This will allow for a subsequent dispense operation to be initiated if needed. In an embodiment of the present invention, a filled coin receptacle is considered to be emptied if it is removed from the apparatus 100. In another embodiment, an extra sensor may be included to check if an inserted coin receptacle is empty or not. The next step is to check S06 if all coins in the specific composition of coins that was selected to be dispensed have been dispensed. If not, the presence of the needed coin cups 166 is checked S03 so that the remaining part of the specific composition of coins may be dispensed. If, on the other hand, all coins from the specific composition of coins have been dispensed, the dispense operation is done S07.

An exemplary dispense operation according to the flowchart in FIG. 7 will now be described. In this exemplary dispense operation there exists coin receptacle for eight different denominations, but only two of them are concerned.

The user wants to dispense 200 coins of denomination 1 (d1) and 100 coins of denomination 2 (d2). The coin receptacle upper limit is 85 coins of denomination 1 and 70 coins of denomination 2. This may lead to the following dispense operation:

1. Insert coin receptacles for d1 and d2.
2. Dispense 85×d1 and 70×d2.
3. Empty coin receptacles for d1 and d2.
4. Insert coin receptacles for d1 and d2.
5. Dispense 85×d1 and 30×d2.
6. Empty coin receptacles for d1 and d2.
7. Insert coin receptacles for d1.
8. Dispense 30×d1.
9. Empty coin receptacles for d1
10. Dispense operation done.

The person skilled in the art realizes that the present invention by no means is limited to the embodiments described above. On the contrary, many modifications and variations are possible within the scope of the appended claims. For example, the steps in the exemplary embodiment of the method described above may be performed in a different order or be combined in any suitable way. The step S01 of initiating the dispense operation and the step S02 of specifying the composition of coins to be dispensed may for example be the same step in an alternative embodiment.

The invention claimed is:

1. A coin deposit and dispensing apparatus having a cabinet serving as an apparatus housing for said apparatus;

a control means for controlling said apparatus;

a cash processing module adapted to receive a deposited mass of coins;

a plurality of dispensers for coins to be dispensed, said dispensers each having a hopper mounted on an ejector/counter, each of said hoppers having an upper part for receiving pre-sorted coins and a lower part connected to the ejector/counter;

a filling compartment comprising a plurality of dispense locations, each dispense location being adapted for receiving one, but any, of a plurality of coin receptacles for collecting dispensed coins from a specific dispenser; and a plurality of coin receptacles, each of the plurality of coin receptacles being adapted for being received in one, but any, of the plurality of dispense locations;

wherein, in a deposit operation the coin deposit and dispensing apparatus is adapted for storing specific coins, and the apparatus is adapted to direct specific types of deposited coins to specific ones of the dispensers for buffering therein;

wherein, in a dispensing operation, the apparatus is adapted to dispense a specific amount of coins from each specific dispenser, under control of said control means, to a coin receptacle at a specific dispense location in said filling compartment; and wherein the control means is adapted to determine needed coin receptacles according to a composition of coins to be dispensed, verify the presence of the needed coin receptacles, and only start said dispense operation at said specific dispense location if a coin receptacle is present at the location.

2. The coin deposit and dispensing apparatus of claim 1, wherein the coin receptacle comprises a coin cup.

3. The coin deposit and dispensing apparatus of claim 1, wherein the coin receptacle comprises a portable coin receptacle.

4. The coin deposit and dispensing apparatus of claim 1, wherein the cash processing module includes a coin acceptance module for processing the deposited mass of coins, each of said hoppers has an upper part for receiving coins from said coin acceptance module; and wherein, in the deposit operation, the coin deposit and dispensing apparatus is adapted for storing and distributing specific coins to specific dispensers, and each dispenser is adapted to receive a specific type of deposited and processed coins for buffering therein.

5. A coin deposit and dispensing apparatus according to claim 1 wherein at least one of the plurality of dispense locations has a sensor arranged to detect presence of a coin receptacle and to forward such information to said control means.

6. A coin deposit and dispensing apparatus according to claim 5, wherein said sensor is capable of identifying a specific identification means on a coin receptacle present at said dispense location, said identification means being associated with a maximum amount of coins to be successively dispensed, and wherein said apparatus in response to detection of such an identification means is adapted for restricting the amount of coins that can be successively dispensed at the dispense location where the identification means has been identified.

7. A coin deposit and dispensing apparatus according to claim 1 wherein the apparatus is adapted for receiving information about a maximum amount of coins that can be successively dispensed to a coin receptacle in dispensing operation, and to forward this information to the control means, and wherein said control means is adapted to, in a dispense operation, only allowing the apparatus to successively dispense said number of a specific coin or coins up to said upper limit.

8. A coin deposit and dispensing apparatus according to claim 7 wherein the apparatus is adapted for receiving information about the maximum amount of a specific coin type that can be successively dispensed to a portable coin receptacle, and wherein the apparatus is adapted for restricting the amount of coins that can be successively dispensed at the dispense location where coins of said coin type are dispensed.

9. A coin deposit and dispensing apparatus according to claim 7 wherein said control means is adapted to start subsequent dispense operation at a certain dispense location if a requested amount of coins exceeds the registered maximum amount for that dispense location.

10. A method for dispensing coins from a coin deposit and dispensing apparatus having a control means for controlling the apparatus, and a filling compartment comprising a plurality of dispense locations;

the method comprising the steps of:

a) initiating, by the control means, a dispense operation;

b) determining, by the control means, a specific amount of coins of each coin type available in the apparatus to be dispensed, each coin type having a determined dispense location associated with the apparatus; and c) determining needed coin receptacles according to a composition of coins to be dispensed; and d) for each dispense location of the composition of coins to be dispensed i) verifying, by a sensor and the control means, the presence of a coin receptacle at the specific dispense location of that coin type; and ii) starting, by the control means, said dispense operation only if there is a coin receptacle present at the specific dispense location and only if an amount of coins of a coin type dispensed at the dispense location has been determined in step b).

11. A method according to claim 10 further comprising the steps of:

indicating, by said control means, any specific dispense location of a specific coin type where no coin receptacle is present.

12. A method according to claim 10 wherein the;

step d), substep i) also comprises detecting presence of an identification means on any coin receptacle present at said dispense location, said identification means being associated with a maximum amount of coins that can be successively dispensed into the coin receptacle at the dispense location, the method further comprising the steps of:

for each dispense location iii) interrupting, by said control means, said dispense operation when an amount corresponding to the maximum amount of coins has been dispensed;

iv) detecting, by said control means, that a coin receptacle has been removed from the specific dispense location followed by detection that a coin receptacle has been entered at the specific dispense location; and v) for the remaining amount of coins, repeating step d),substeps ii), iii) and iv) until the whole amount of the coin type that was specified in step b) has been dispensed.

13. A method according to claim 10, wherein step b) further comprises a maximum amount of coins of a certain coin type that successively can be dispensed is determined, said coins of said coin type being dispensed at a specific dispense location;

the method further comprising the steps of:

for each dispense location iii) checking the maximum amount of coins that can be successively dispensed at the dispense location and interrupting, by said control means, said dispense operation when an amount corresponding to the maximum amount of coins has been dispensed;

iv) detecting, by said control means, that a coin receptacle has been removed from the specific dispense location followed by detection that a coin receptacle has been entered at the specific dispense location; and v) for the remaining amount of coins, repeating step d), substeps ii), iii) and iv) until the whole amount of the coin type that was determined in step b) has been dispensed.

14. A method according to claim 10 wherein a coin receptacle is presumed empty when inserted at a dispense location.

15. A method according to claim 10 wherein step d), substep i) is carried out in such a way that the control means initially checks if a coin receptacle has been removed from the specific dispense location since the latest dispense operation was carried out, and if no coin receptacle has been removed, the method is interrupted until the coin receptacle has been removed; and if a coin receptacle has been removed, the method proceeds with the method of claim 10 at step d) substep i).

16. A storage medium containing instructions that when executed cause a computer system to facilitate a method for dispensing coins from a coin deposit and dispensing apparatus having a control means for controlling said apparatus and a filling compartment comprising a plurality of dispense locations, by a) initiating, by a control means, a dispense operation;

b) specifying a specific amount of coins of each coin type available in an apparatus to be dispensed, each coin type having a determined dispense location associated with the apparatus; and c) determining needed coin receptacles according to a composition of coins to be dispensed; and d)

i) verifying, by a sensor and said control means, the presence of a coin receptacle at the specific dispense location of that coin type for each dispense location of the composition of coins to be dispensed; and ii) starting, by said control means, said dispense operation only if there is a coin receptacle present at the specific dispense location and only if an amount of coins of a coin type dispensed at the dispense location has been specified for each dispense location.

17. A graphical user interface for communication between a user and a computer set up to run instructions that when executed facilitate the dispensing of coins from a coin deposit and dispensing apparatus, the graphical user interface having:

a section for specifying the specific amount of coins of each coin type that is to be dispensed, each such coin type having a determined dispense location; and a section for indicating if a coin receptacle is present or not in the determined dispense location of each coin type.

18. A graphical user interface according to claim 17 further having:

a section for indicating whether any coin receptacle present at a dispense location has not been emptied since a previous dispense operation.

* * * * *